US006644673B2

(12) United States Patent
Longino

(10) Patent No.: US 6,644,673 B2
(45) Date of Patent: Nov. 11, 2003

(54) INDEPENDENT SUSPENSION SYSTEM FOR IN-LINE SKATES HAVING ROCKER ARMS AND ADJUSTABLE SPRINGS

(75) Inventor: Robert Keith Longino, Chicago, IL (US)

(73) Assignee: Sprung Suspensions, Inc., Chicago, IL (US)

( * ) Notice: Subject to any disclaimer, the term of this patent is extended or adjusted under 35 U.S.C. 154(b) by 0 days.

(21) Appl. No.: 10/214,270

(22) Filed: Aug. 7, 2002

(65) Prior Publication Data

US 2002/0190488 A1 Dec. 19, 2002

Related U.S. Application Data

(60) Division of application No. 09/878,366, filed on Jun. 11, 2001, now Pat. No. 6,454,280, which is a continuation-in-part of application No. 09/264,451, filed on Mar. 8, 1999, which is a continuation-in-part of application No. 09/254,533, filed as application No. PCT/US97/15786 on Sep. 5, 1997.

(60) Provisional application No. 60/025,545, filed on Sep. 6, 1996.

(51) Int. Cl.[7] ..... A63C 17/06

(52) U.S. Cl. ..... 280/11.28; 280/11.221; 280/11.225; 280/11.215

(58) Field of Search ..... 280/11.28, 11.221, 280/11.225, 11.115, 11.19, 11.26, 11.223, 11.232

(56) References Cited

U.S. PATENT DOCUMENTS

| | | | |
|---|---|---|---|
| 329,582 | A | 11/1885 | Miller |
| 904,270 | A | 11/1908 | Lippy |
| 1,609,612 | A | 12/1926 | Eskeland |
| 2,557,331 | A | 6/1951 | Wintercorn |
| 2,572,133 | A | 10/1951 | Glenn |
| 2,644,692 | A | 7/1953 | Kahlert |
| 3,377,079 | A | 4/1968 | Barczak |
| 3,545,779 | A | 12/1970 | Simms |
| 3,568,555 | A | 3/1971 | Stroh |
| 4,272,090 | A | 6/1981 | Wheat |
| 4,278,264 | A | 7/1981 | Lenz |
| 4,351,538 | A | 9/1982 | Berta |
| 4,373,736 | A | 2/1983 | Stumbaugh |
| 4,402,521 | A | 9/1983 | Mongeon |
| 4,817,974 | A | 4/1989 | Bergeron |
| 4,838,564 | A | 6/1989 | Jarvis |
| 5,029,882 | A | 7/1991 | Marandel |
| 5,048,848 | A | 9/1991 | Olson et al. |
| 5,085,445 | A | 2/1992 | Boyden |
| 5,135,244 | A | 8/1992 | Allison |
| 5,232,231 | A | 8/1993 | Carlsmith |
| 5,342,071 | A | 8/1994 | Soo |
| 5,372,383 | A | 12/1994 | Kubierschky |
| 5,390,958 | A | 2/1995 | Soo |
| 5,398,949 | A | 3/1995 | Tarng |
| 5,405,156 | A | 4/1995 | Gonella |
| 5,413,362 | A | 5/1995 | De Santis |
| 5,478,094 | A | 12/1995 | Pennestri |
| 5,478,095 | A | 12/1995 | Marandel |
| 5,486,011 | A | 1/1996 | Nelson |

(List continued on next page.)

FOREIGN PATENT DOCUMENTS

| | | |
|---|---|---|
| DE | 233545 | 6/1910 |
| DE | 654100 | 12/1937 |
| EP | 559179 | 9/1993 |
| WO | WO 93/12846 | 7/1993 |
| WO | WO 93/12847 | 7/1993 |
| WO | WO 93/14840 | 8/1993 |

*Primary Examiner*—Paul N. Dickson
*Assistant Examiner*—Toan C To

(57) ABSTRACT

The present invention provides a suspension system for in-line skates. The in-line skate includes a boot and a tracking system attached to the sole of the boot. Opposing rocking arms that hold the wheels are connected to the tracking system using a truncated axle. In addition, an adjustable spring can be configured between the opposing rocker arms.

2 Claims, 16 Drawing Sheets

U.S. PATENT DOCUMENTS

| | | | | | |
|---|---|---|---|---|---|
| 5,501,474 | A | | 3/1996 | Conte | |
| 5,503,413 | A | | 4/1996 | Belogour | |
| 5,536,025 | A | | 7/1996 | Landay | |
| 5,551,713 | A | | 9/1996 | Alexander | |
| 5,582,418 | A | | 12/1996 | Closser | |
| 5,704,621 | A | | 1/1998 | Lazarevich et al. | |
| 5,806,551 | A | | 9/1998 | Meloul et al. | |
| 5,816,588 | A | | 10/1998 | Nicoletti | |
| 5,904,360 | A | | 5/1999 | Oliemans et al. | |
| 5,931,480 | A | | 8/1999 | Schroeder | |
| 6,227,551 | B1 | * | 5/2001 | Roy | 280/11.223 |
| 6,354,608 | B1 | * | 3/2002 | Syrkos | 280/11.225 |
| 6,425,587 | B1 | * | 7/2002 | Moon | 280/11.206 |
| 6,435,524 | B1 | * | 8/2002 | Kuncz | 280/11.221 |
| 6,478,313 | B1 | * | 11/2002 | Gray | 280/11.223 |
| 6,491,309 | B1 | * | 12/2002 | Sheldon | 280/11.27 |

* cited by examiner

FIG. 10
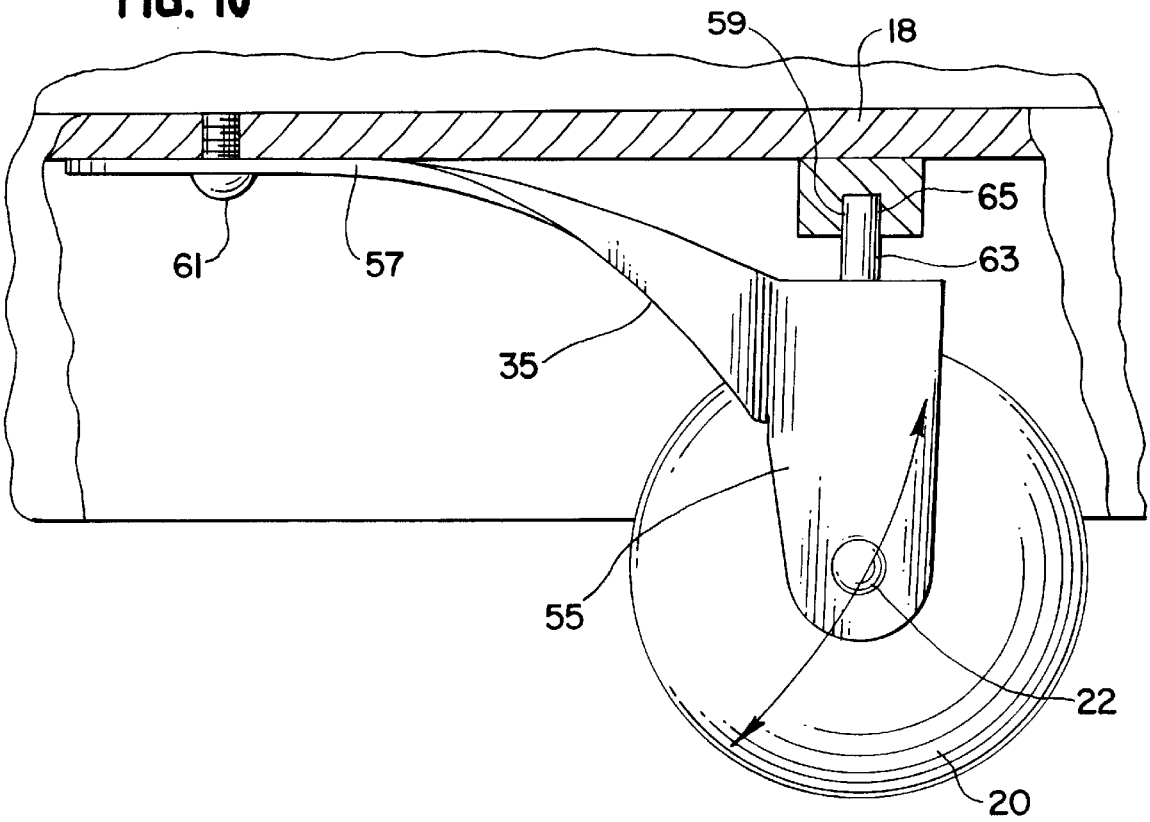
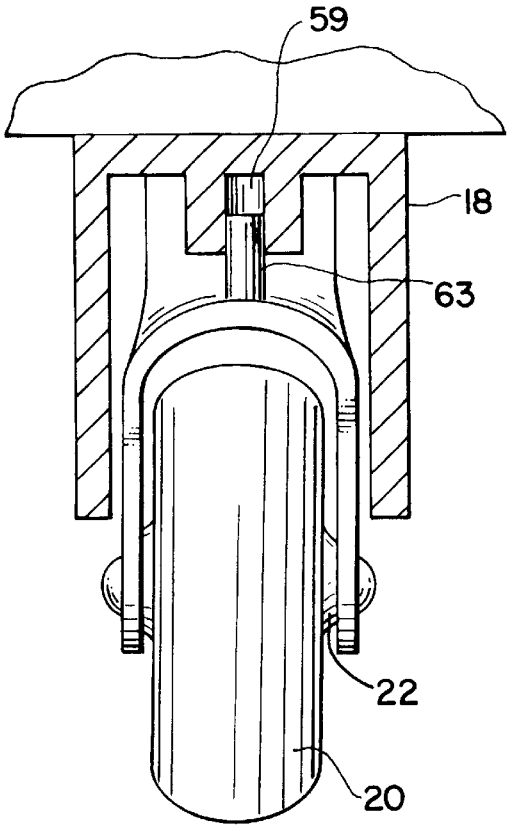
FIG. 11

INDEPENDENT SUSPENSION SYSTEM FOR IN-LINE SKATES HAVING ROCKER ARMS AND ADJUSTABLE SPRINGS

This a division of application Ser. No. 09/878,366 filed on Jun. 11, 2001 now U.S. Pat. No. 6,454,280.

BACKGROUND OF INVENTION

1. Field of the Invention

The invention relates to in-line skates, and, in particular, to an independent suspension system to attach the wheels of an in-line skate to the skate's boot where the suspension system allows the wheels to move individually relative to the ground and the boot and that includes an adjustable spring.

2. Scope of the Prior Art

In-line skates have become very popular recreational and sporting equipment. They have essentially replaced regular roller-skates, and are used by speed skaters and ice-hockey players for dry-land activities. Many individuals and families use them for outings and exercise.

In general, in-line skates are used outside on sidewalks and other road surfaces. These surfaces are generally not flat and have bumps, ridges and holes. The uneven surfaces can cause stress on the wheels, boots and other structural elements of the skate as well as discomfort for the skater. Often, the uneven surfaces can be treacherous for riding.

In the past, systems and mechanisms have been developed to assist in the breaking and steering of in-line skates. In addition, systems have been developed to improve the ride of the in-line skates. Some of these systems include a mechanism for the wheels to move relative to the boot, but they do not necessarily provide an adequate mechanism to improve the suspension of the in-line skate so that the skate will absorb the shocks caused on the skate by uneven riding surfaces. To improve the ride, some prior art system use standard coil springs. Those coil springs can be bulky, heavy and not entirely effective in providing the desired ride for the in-line skate. In addition, the prior art springs are not generally variable thereby requiring that the springs be replaced in order to adjust the ride. Those springs that are available add additional weight and bulk to the skate thereby making them impracticable.

SUMMARY OF THE INVENTION

The purpose of the present invention is to overcome the limitations of the prior art and to develop a suspension system for an in-line skate that improves the performance and ride of the skate. The invention absorbs the shocks caused on the skate by uneven riding surfaces and retains traction better as the load on the heel from the foot in the skate shifts forward and backward. The invention includes a mechanism that allow the wheels to move relative to the boot of the skate so that when the wheels encounter uneven surfaces or the foot shifts forward or to the rear, the wheels move individually and independently to overcome the shifts in weight distribution and uneven surface thereby providing a better performing skate with a smoother ride. This arrangement reduces the impact and stress on the boot and, therefore, the impact and stress on the person using the skates. The suspension mechanism can be arranged so that the wheels can move in a dual action movement in more than one place.

The suspension mechanism, which allows the wheels to move relative to the boot, includes a spring or other biasing device that limits the wheel movement and absorbs the shock when the wheels encounter uneven weight distribution from the boot and the uneven surface and an attachment mechanism to connect the wheels to the boot. The biasing device can include a spring, flexible plastic or metal, or another type of energy absorbing system. The biasing device, or spring, can also be designed so that it is adjustable. The adjustable spring allows the in-line skate user to adjust the resistance and flexibility of the spring to modify the firmness of the ride for different conditions. Aggressive in-line skaters can thereby adjust the tension, resistance and flexibility of the springs so that the in-line skate performs differently according to the weight of the skates, the desired performance and the surface on which it is being used.

The suspension system can include two rotatable and opposing rocker arms that have the adjustable spring between them. Each arm is connected to a wheel. The arms each pivot about an axle. The axle on which the wheel pivots is designed to optimize the space for the wheels in the arms. Therefore, each pivot axle is truncated and does not continue from one side of the arm to the other. This allows the wheels to be as close together as possible.

In a typical in-line skate, the wheels are rotatably attached to a tracking system, which is, in turn, attached to the sole of the boot. In order to simplify the design of the suspension system, the present invention fits within the confines of the tracking system of a traditional in-line skate. Furthermore, the suspension mechanism is designed so that the dimensions of the skate, such as clearance from the ground, are not modified considerably. It is also desirable to design the suspension mechanism and the tracking system so that parts can be easily replaced.

BRIEF DESCRIPTION OF THE DRAWINGS

FIG. 10 is a fragmented side view of still another embodiment of the suspension mechanism of the present invention;

FIG. 11 is a front view of the suspension mechanism shown in FIG. 10;

DETAILED DESCRIPTION OF THE INVENTION

Figure 1:
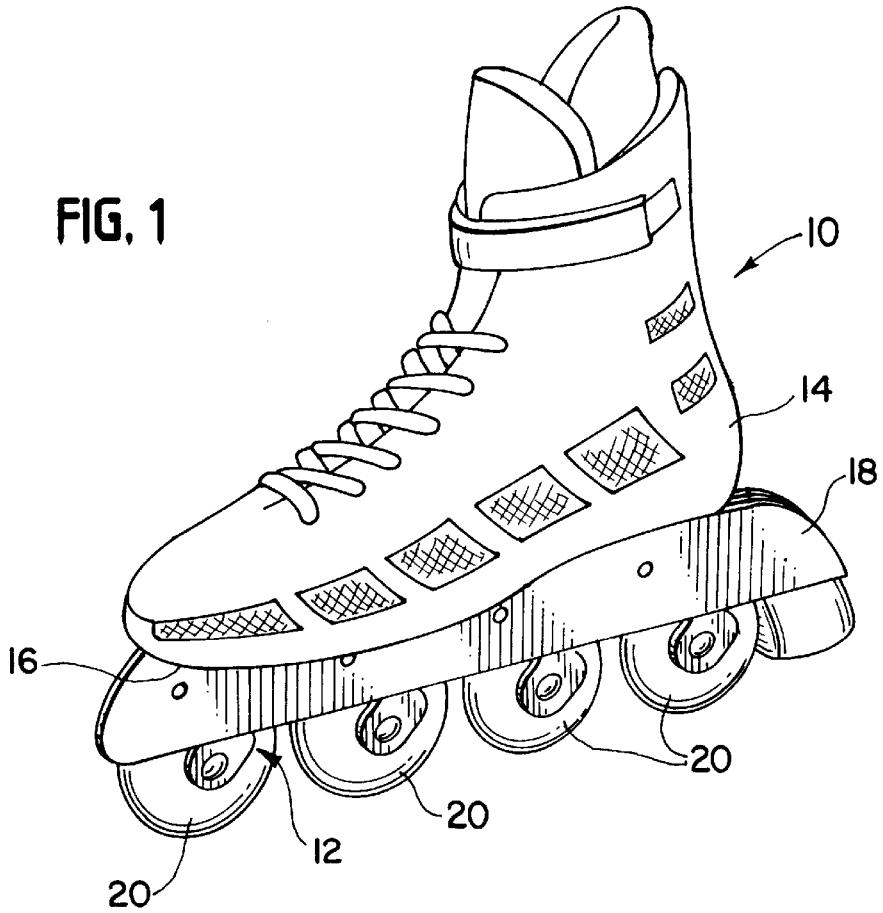
FIG. 1 shows an in-line skate including a boot, tracking system, wheels and one embodiment of the suspension mechanism of the present invention.

FIG. 1 illustrates an in-line skate 10 that includes a suspension mechanism 12 made in accordance with the principals of the present invention. The in-line skate 10 includes a boot 14 that is configured to hold and support the foot of the wearer. The boot includes a sole 16 that has a tracking system 18 attached to it. The tracking system 18 is made of any suitable material and is typically made of aluminum. The tracking system 18 has a series of wheels 20 rotatably attached to it so that the wheels form a line. In a traditional in-line skate 10, the wheel 20 can be rotatably attached to the tracking system 18 using axles 22. For the present invention, however, the wheels 20 are connected to the tracking system using a suspension mechanism 12. The suspension mechanism 12 allows the wheels 20 to move individually and independently relative to the boot 14 so that the in-line skate 10 can move smoothly over an uneven surface.

Figure 2:
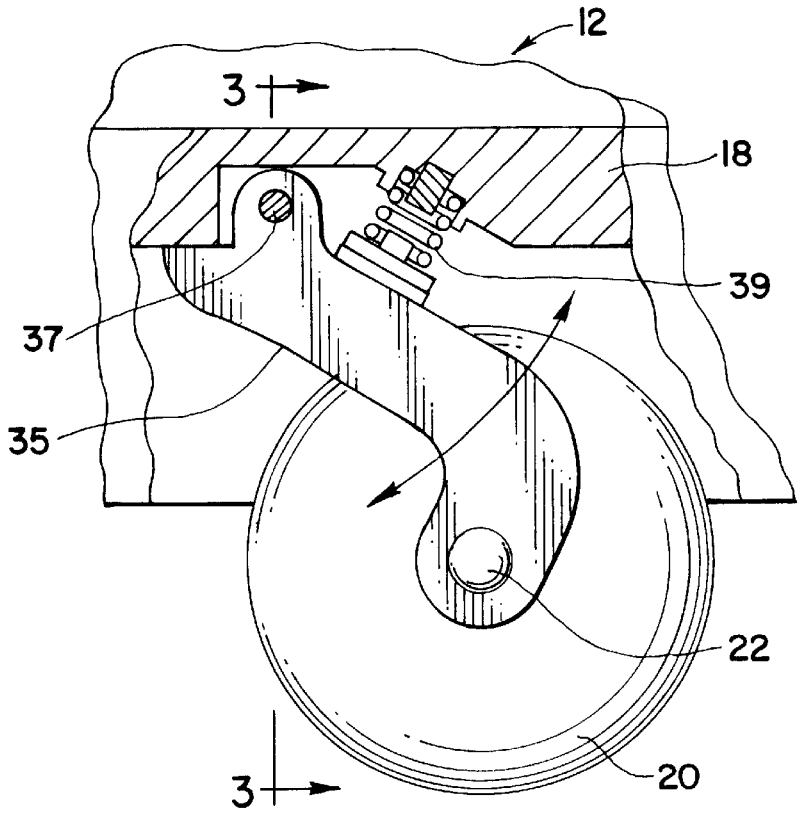
FIG. 2 is a fragmentary view of suspension mechanism illustrated in FIG. 1.
Figure 3:
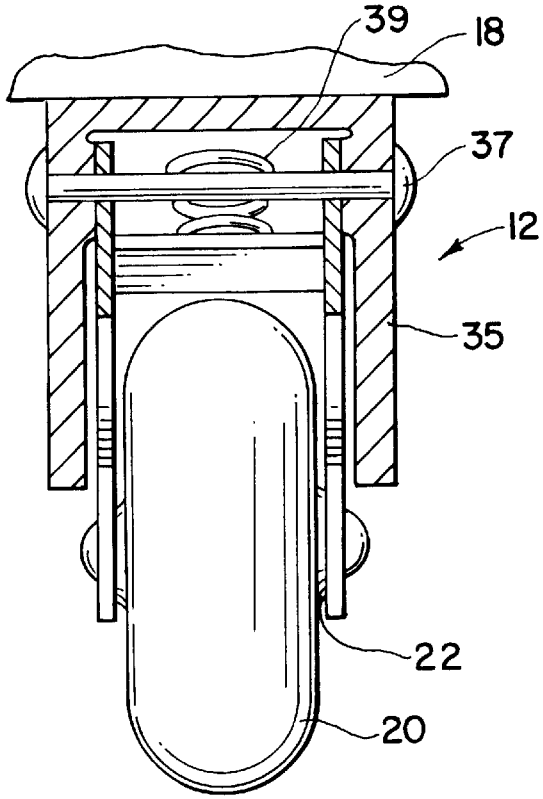
FIG. 3 is a cross-sectional view of the suspension mechanism taken along the line 2—2 in FIG. 2.
Figure 4:
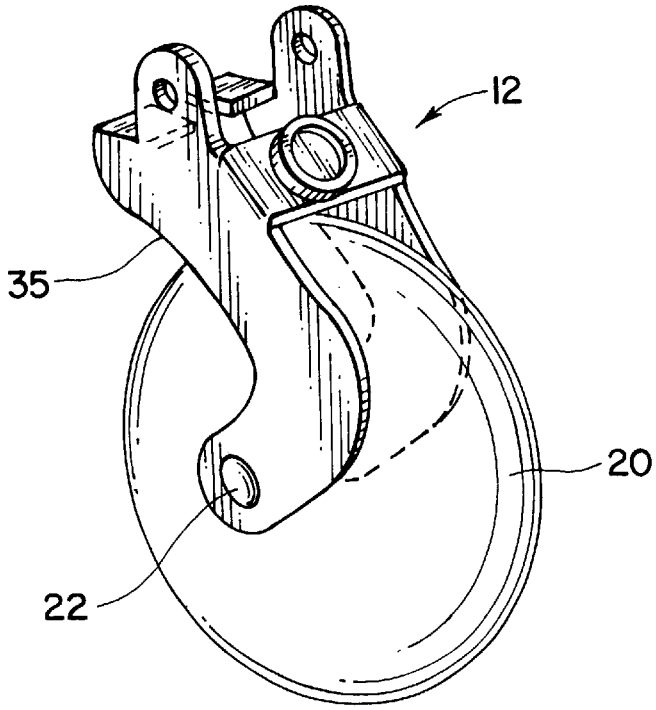
FIG. 4 is a perspective view of the wheel and attachment means of the suspension mechanism shown in FIG. 2.

FIGS. 2–4 shows one embodiment of the suspension mechanism 12 according to the principals of the present invention. The suspension mechanism 12 includes an attachment mechanism 35. The attachment mechanism 35 is movably connected at one end to the tracking system 18 by a pin 37. The other end of the attachment mechanism 35 has the wheel rotatably attached to it by an axle 22. The attachment mechanism 35 is angled in between the tracking end and the wheel 20 end so that when the wheel hits an uneven surface the suspension mechanism pivots about the pin 37 in an arcuate path. This arrangement reduces the shock created by an uneven surface to the boot 14. Each wheel 20 in the in-line skate 10 is connected to the tracking system 18 in a similar manner. Thus, each wheel 20 can move individually and independently of the others relative to the boot.

In the preferred embodiment of this embodiment, the suspension mechanism 18 includes a biasing device 39 to absorb the pressure when the wheel 20 encounters an uneven surface and to hold the wheel in place. As seen in the figures, biasing device 39 can be a typical spring. Of course, any type of biasing device can be used such as flexible plastic, polyurethane, metal or another type of energy absorbing system. The biasing device 39 is connected between the tracking system 18 and the center portion of the attachment mechanism 35. The biasing device 39 is biased so that the wheel 20 is held in place during normal operation of the in-line skate 10 and absorbs the shock of the wheel 20 when the wheel 20 encounters an uneven surface. The biasing device 39 can also be biased to relieve the pressure on the boot 14 when the wheels 20 encounter the surface during the natural skating motion.

Figure 5:
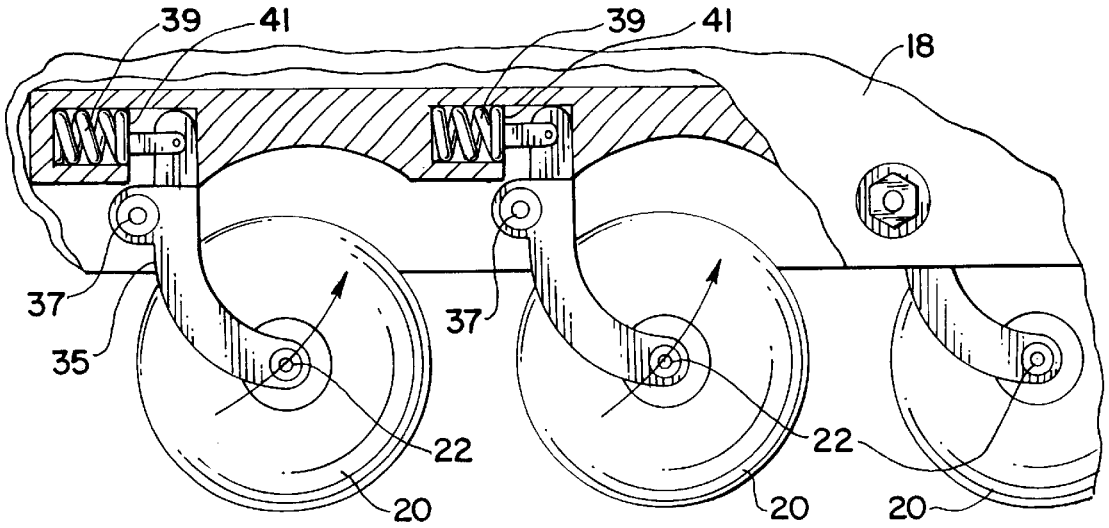
FIG. 5 is a fragmented side view of another embodiment of the suspension mechanism according to the present invention.
Figure 6:
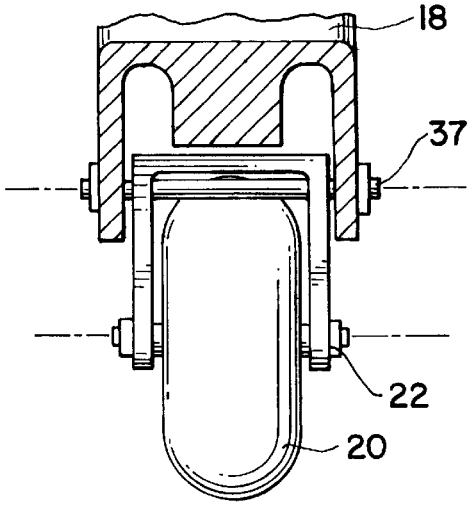
FIG. 6 is a cross-sectional view of the embodiment shown in FIG. 5 taken along the line 6—6.
Figure 7:
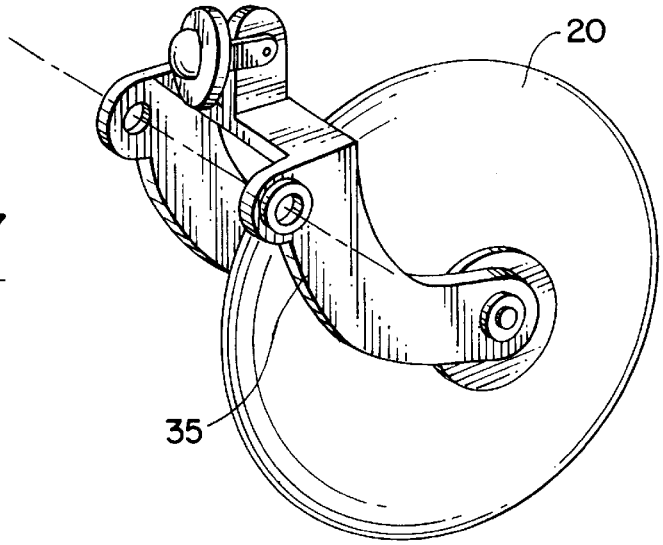
FIG. 7 is a perspective view of the wheel and attachment means of the suspension mechanism shown in FIG. 5.

FIGS. 5–7 illustrate another embodiment of the suspension mechanism 12 of the present invention. This embodiment includes an attachment mechanism 35 that has an arcuate-shape. The attachment mechanism is connected to the tracking system 18 at a point between the ends by a pin 37. One end of the attachment mechanism 35 is connected to a biasing device 39 which is engaged to the tracking system 18. The tracking system 18 also includes a channel 41 to position the attachment mechanism 35. The wheel 20 is rotatably connected to the other end of the attachment mechanism by an axle 22. In this arrangement the attachment mechanism 35 pivots about the pin 37 when the wheel encounters an uneven surface. The biasing device 39 is biased to absorb the shock and movement of the attachment mechanism. When the biasing device 39 returns the channel 41 positions the attachment mechanism 35 and wheel 20 to its original position. The biasing device 39 can also be configured to absorb the shock of the wheels encountering a surface during the skating motion of the user. Of course, another sort of biasing device 39 other than a spring shown can be used.

Figure 8:
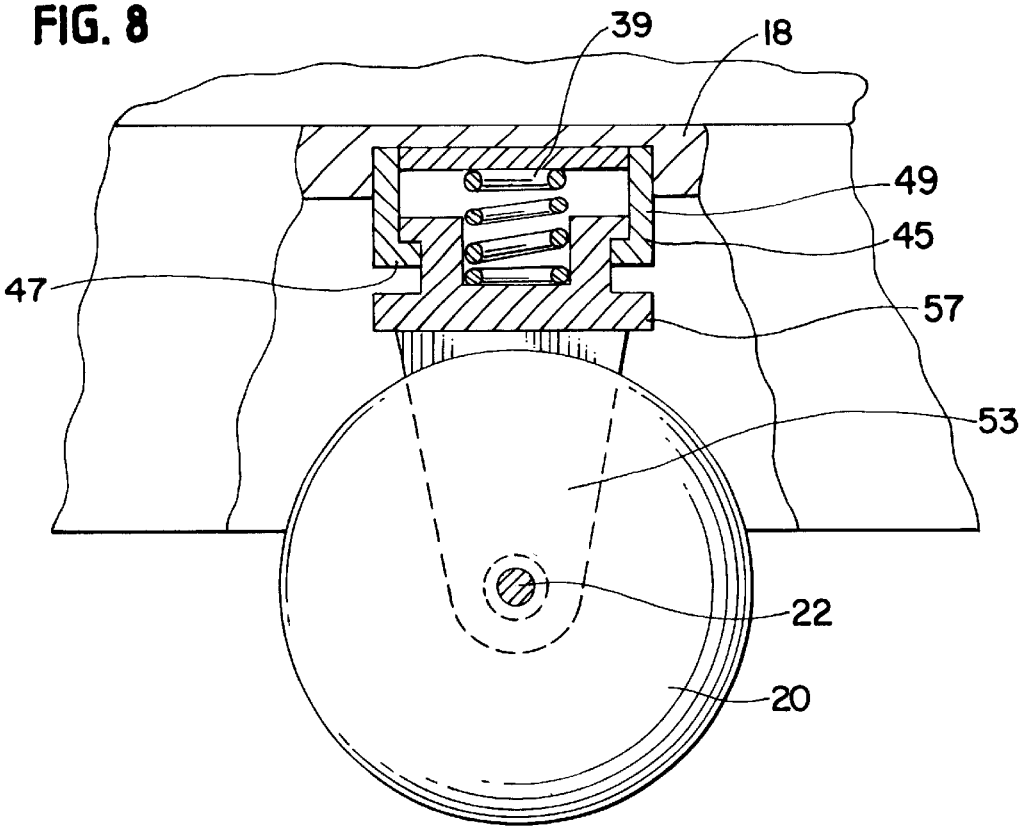
FIG. 8 is a fragmented side of yet another embodiment of the suspension mechanism of the present invention.
Figure 9:
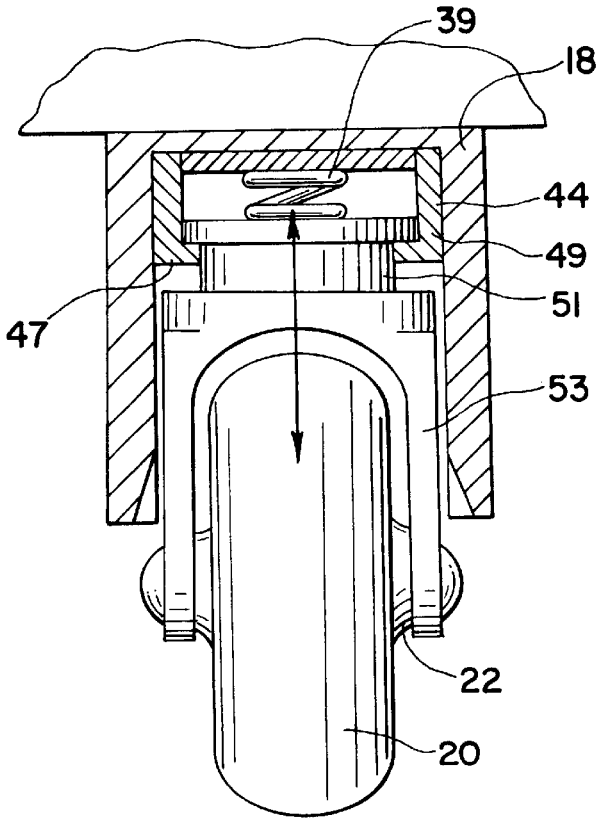
FIG. 9 is a front view of the suspension mechanism shown in FIG. 8.

FIGS. 8–9 illustrate yet another embodiment of the suspension mechanism 12 of the present invention where the wheels 20 move in a vertical pattern when they encounter uneven surfaces. The attachment mechanism 35 includes a channel 45 portion that is rigidly connected to the tracking system at its closed end. The open end of the channel includes ribs 43 that are perpendicular to the sides 49 of the channel 45. A mating member 51 is movably engaged at one end into the channel at its upper end. The ribs 47 of the channel 45 hold the mating member 51 within the channel 45. The other end of the mating member is rigidly connected to a u-shaped bracket 53. The wheel 20 is rotatably connected to the bracket by an axle 22. Within the chamber 45 formed by the channel and mating member a biasing device 39 is positioned. As seen in the figures, the biasing device 39 can be any sort of energy absorbing system such as a spring or flexible material and be within the scope of the invention. The biasing device 39 is biased so that the wheel 20, bracket 53 and mating member 51 move vertically when the wheel 20 encounters an uneven surface. The biasing device 39 can also be configured to absorb the shock achieved when the wheels engage a surface during a normal skating motion.

Figure 12:
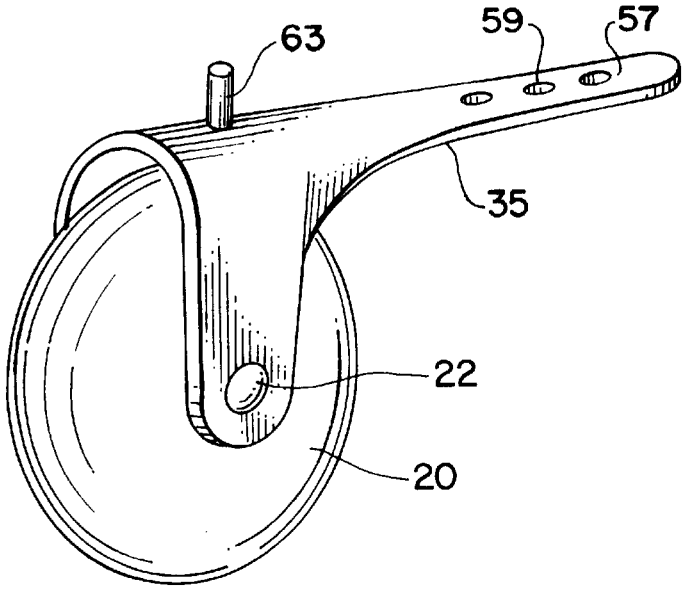
FIG. 12 is a perspective view of the wheel and attachment means of the suspension mechanism shown in FIG. 10.
Figure 13:
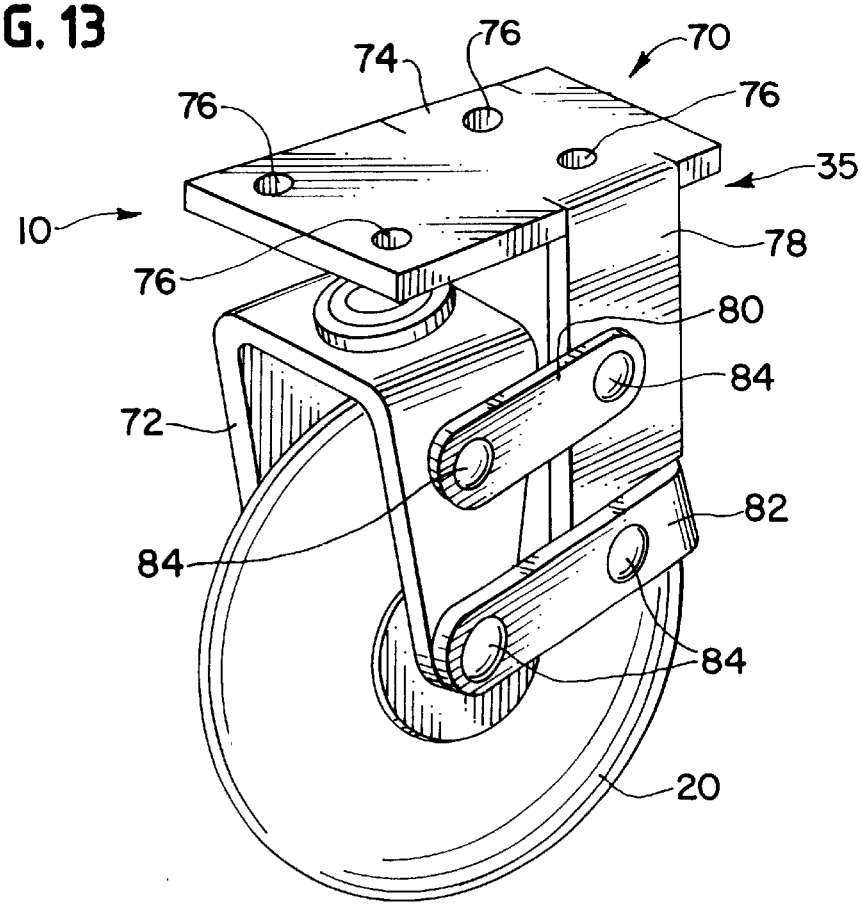
FIG. 13 is a perspective view of a further embodiment of the suspension mechanism of the present invention.
Figure 14:
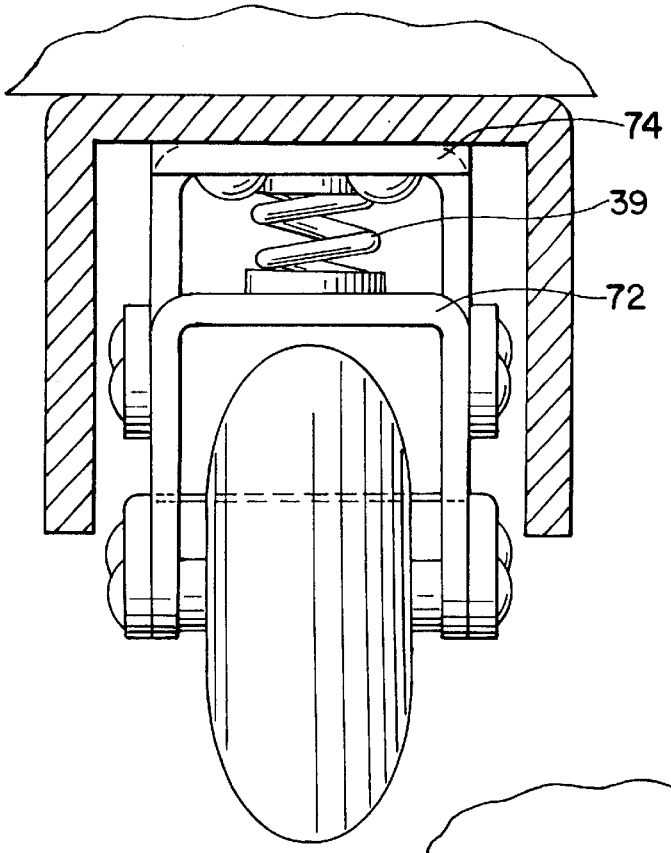
FIG. 14 is a front view of the suspension mechanism shown in FIG. 13.
Figure 15:
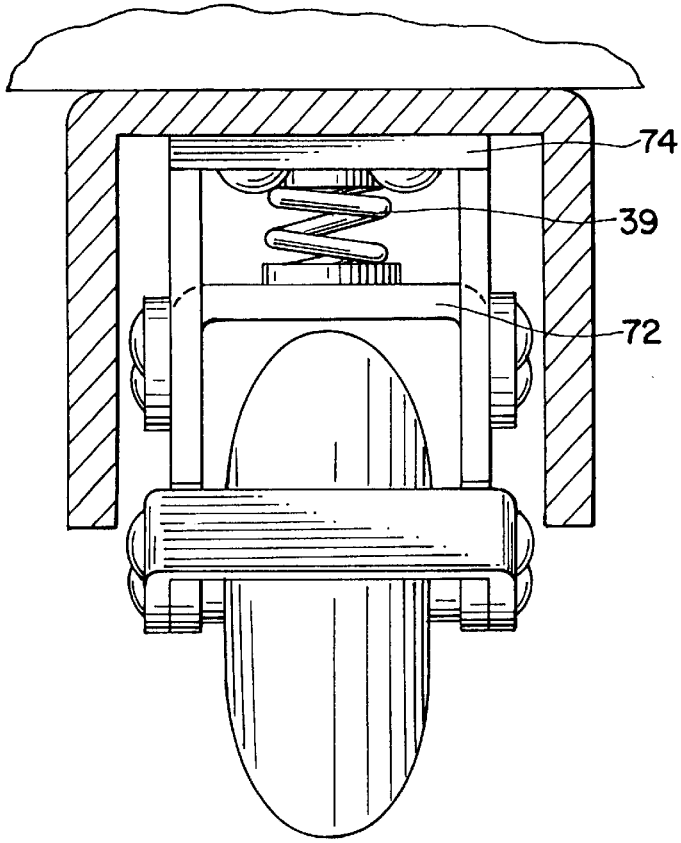
FIG. 15 is a rear view of the suspension mechanism shown in FIG. 13.
Figure 16:
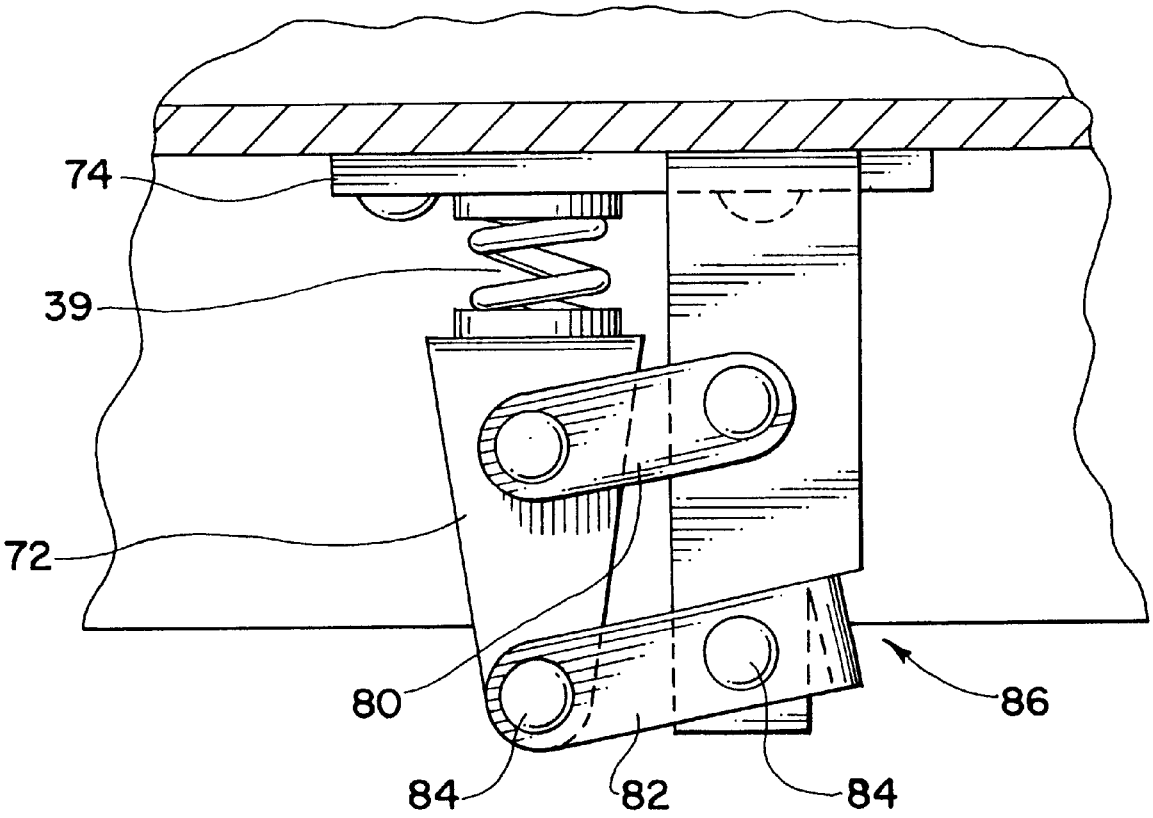
FIG. 16 is a side view of the attachment mechanism shown in FIG. 13.

FIGS. 10–12 illustrates still another embodiment of the present invention where the wheels 20 pivot in an arcuate pattern. The attachment mechanism 35 includes a u-shaped end 55 that is connected to the wheel by an axle 22. The attachment mechanism 35 connects to the tracking system 18 by an arm 57 extending from a side of the u-shaped end 55. The arm 57 includes a series of holes 59 that are used to connect the attachment mechanism to the tracking system 18 by a screw 61. The different holes 59 in the arm adjust the flexibility of the arm 59. A pin 63 is provided at the upper side of the u-shaped end 55 and fits into a hole 59 in the tracking system 18. The pin 63 provides stability for the attachment mechanism 35. When the wheel 20 encounters an uneven surface, the arm flexes so that the wheel moves in a path while the pin 63 provides guidance and rigidity. The amount of shock absorbed by the attachment mechanism 35 depends on which hole the screw 61 is placed.

FIGS. 13–16 illustrate a further embodiment of the present invention where the wheels 20 move in a vertical pattern when they encounter uneven surfaces. The attachment mechanism 35 includes an upper portion 70 that connects to the tracking system 18 and a lower portion 72 that connects to the wheel 20. The upper portion 20 includes a plate 74, which has a number of holes 76. From the opposing edges of the plate, side arms 78 extend perpendicularly. Screws (not shown) are placed through the holes 76 to attach the suspension mechanism 12 to the tracking system 18.

The lower portion 72 has a generally C-shaped cross-section that surrounds the wheel 20. The upper portion 70 and lower portion 72 are connected to one another by bars 80 and 82. Bars 80 and 82 connect one side of the C-shaped lower portion 72 to the arms 78 of the upper portion. Bars 80 and 82 are used on each side of the suspension mechanism 10 so that the wheels 20 move in a vertical pattern when they encounter uneven surfaces. The bars 80 are connected to the lower and upper portion by pins 84 so that the bars 80 can rotate about the pins 82. One of the pins 84 can serve as an axle for the wheels 20.

The embodiment shown in FIGS. 13–16 includes a biasing device 39 that is biased between the plate 74 and the lower portion 72. The biasing device 39 is configured to absorb the shock and movement of the attachment mechanism and to permit the lower portion 72 to move vertically relative the upper portion 70 when the wheel 20 encounters an uneven surface. The biasing device 39 can also be configured to absorb the shock achieved when the wheels engage a surface during a normal skating motion.

The embodiment of the suspension mechanism 10 shown in FIGS. 13–16 includes a stopping mechanism 86 that limits the vertical movement of the lower portion 72 relative the upper portion 70. The stopping mechanism 86 is formed from the arms 78 and the lower bars 82. At the lower end of each arm 78 a portion of the side is removed so that each arm 78 is L-shaped. The bars 82 are connected together by a bridge 86. This bridge 86 fits into the removed portion of the arms so that the bridge stops the movement of the lower portion 72 when it encounters the edge of the upper portion 78. The stopping mechanism 86 and the biasing device 39 work together to limit the motion of the wheel 20 when it encounters uneven surfaces. All embodiments of the present invention can include a stopping mechanism similar to the stopping mechanism 87 shown.

Figure 17:
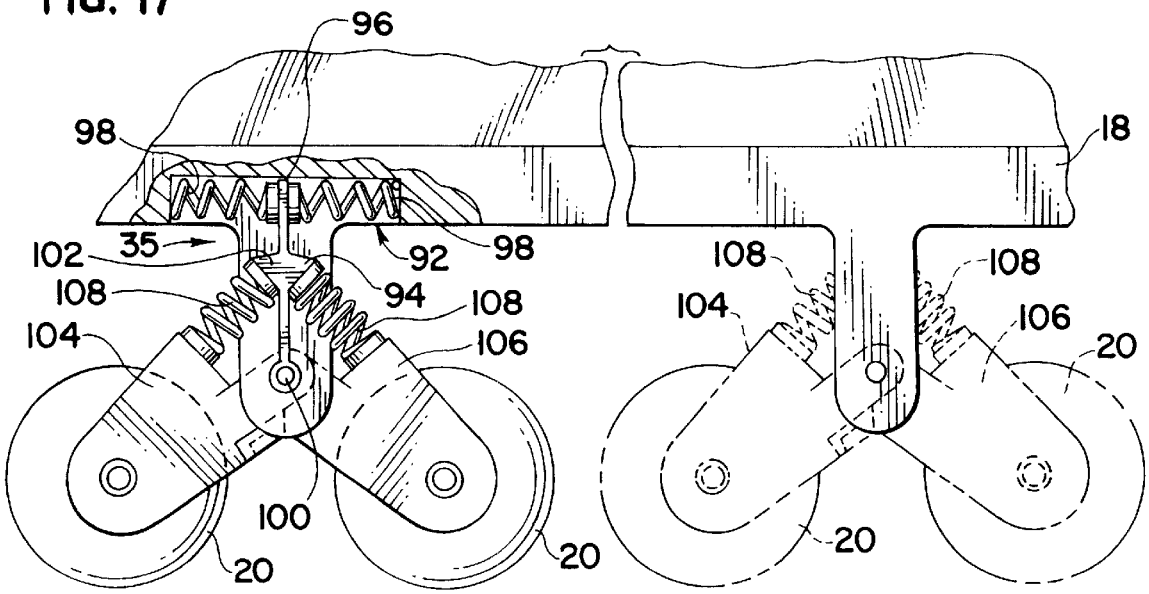
FIG. 17 is a side view of yet another embodiment of the suspension mechanism of the present invention and includes a partial cut-away view.
Figure 18:
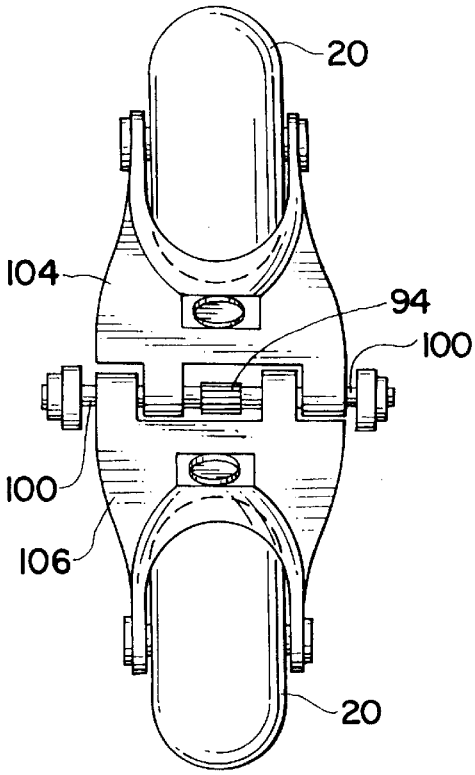
FIG. 18 is a top view of the suspension mechanism shown in FIG. 17.
Figure 19:
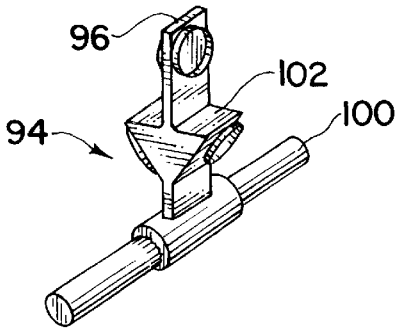
FIG. 19 is a perspective view of a portion of the attachment mechanism for the suspension mechanism shown in FIG. 17.

FIGS. 17–19 illustrate yet another embodiment of the present invention and provide a suspension mechanism 12 that has dual action movement so that the wheels 22 can move individually and independently in more than one direction. The tracking system 18 includes a series of channels 92. The attachment mechanism 35 includes a live axle 94, which is shown in FIG. 18. The top end 96 of the live axle 94 connects to the upper surface of channel 92 and is supported by first biasing device 98 at either side. The first biasing device 98 also connects into the end walls of the channel 92. The opposite end of the live axle 92 includes a rod 100 and between the rod 100 and the top end 96 is a wedge 102.

The attachment mechanism 35 in this embodiment also includes a first arm 104 and a second arm 106. The first and second arms 104, 106 are both connected at one end to the rod 100 so that the arms rotate about the rod 100. The wheels are connected to the other end of the arms 104, 106 by axles 38. A second biasing device 108 can be configured between the arms 104, 106 and the wedge 102 to absorb the movement of the arms as they rotate about the rod 100 when the wheels engage on an uneven riding surface. In this arrangement, wheels 20 connected to arms 104 and 106 move in a clockwise and counter-clockwise arcuate path, respectively, about the rod 100. According to the connection between the live axle and the tracking system, the wheels can also move in a path relative to the top end 96, such that the top end 96 engages the first biasing device 98 to absorb the shock when the wheels 20 encounter an uneven surface. Both the first and second biasing device 98 and 108 are configured to keep the wheels in one position in the steady state.

Figure 21:
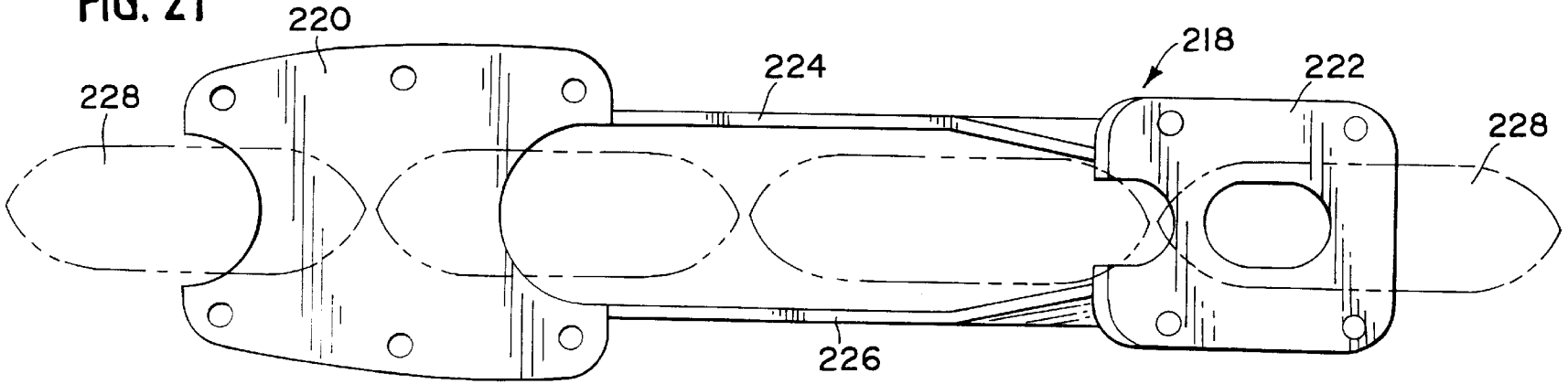
FIG. 21 is a top view of the embodiment shown in FIG. 20.
Figure 20:
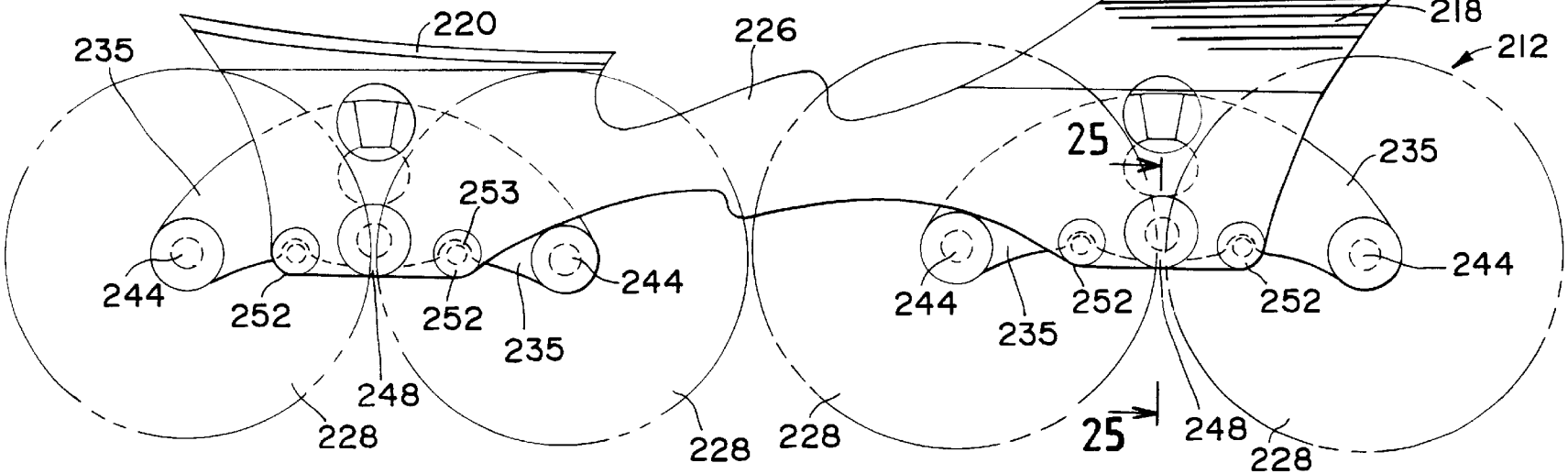
FIG. 20 is a side view of a further embodiment of the present invention.

FIGS. 20–26 illustrate a further embodiments of the present invention that include a suspension system 212 made in accordance with the principles of the present invention. The tracking system 218 attaches the suspension mechanism 212 to a boot like that seen in FIG. 1. As seen in FIG. 21, a fore plate 220 and an aft plate 222 are used to connect the tracking system 218 to the boot using bolts (not shown) or other suitable methods well known in the art. The tracking system 218 includes two side panels 224, 226 extending down from and between the fore and aft plates 220, 222. The side panels can be of any shape and design. The wheels 228 used by the in-line skate are positioned between the two panels 220, 222. As described above, the tracking system 218 can be made of any suitably strong material such as aluminum.

Figure 22:
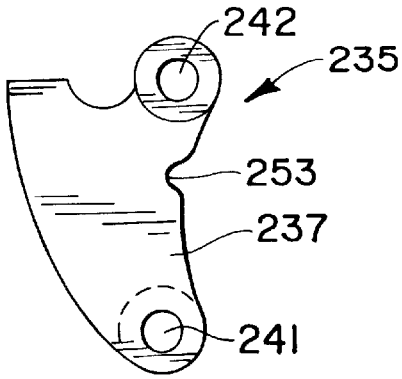
FIG. 22 is detailed drawing of the rocker arms shown in FIG. 20.
Figure 23:
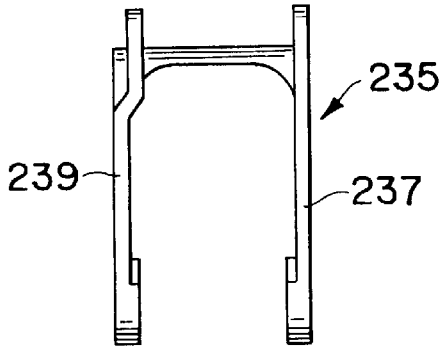
FIG. 23 is an end view of the rocker arm shown in FIG. 23.

Referring to FIGS. 21–23, the suspension mechanism 212 also has two pairs of rocker arms 235 to provide a limited swing rocker arm suspension with opposed four wheels for an in-line skate. There is one arm 235 for each wheel 228. The rocker arms have a somewhat triangular shape and a C-shaped cross-section so that the wheel can fit between the sides 237, 239 of each arm 235. At the base of each side 237, 239, the arms 235 include holes 241 and 243 at opposing ends. Between holes 241 and 242 a notch 243 is formed into the bottom edge of the arms 235. Wheels 228 rotate about an axle 244 that goes through hole 241.

Figure 24:
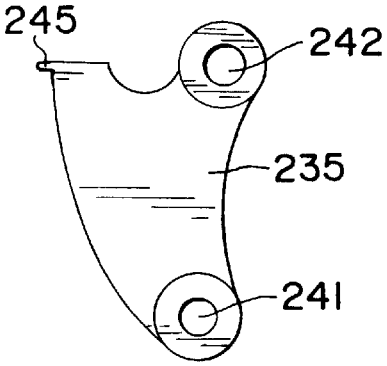
FIG. 24 is a detailed drawing of an alternative embodiment of the rocker arms shown in FIG. 22.

FIG. 24 illustrates another embodiment of the pivoting arms 235. In this embodiment, the pivoting arms 235 maintain their somewhat triangular shape shown in FIG. 22.

In addition, the arms 235 have a C-shaped cross-section shown in FIG. 23 so that the wheel can fit between the sides of each arm 235. Similarly, the arms in FIG. 24 include holes 241 and 242 at opposing ends of the bottom edge. At the other end opposing hole 242, a lip 245 projects from the arm 235.

Figure 25:
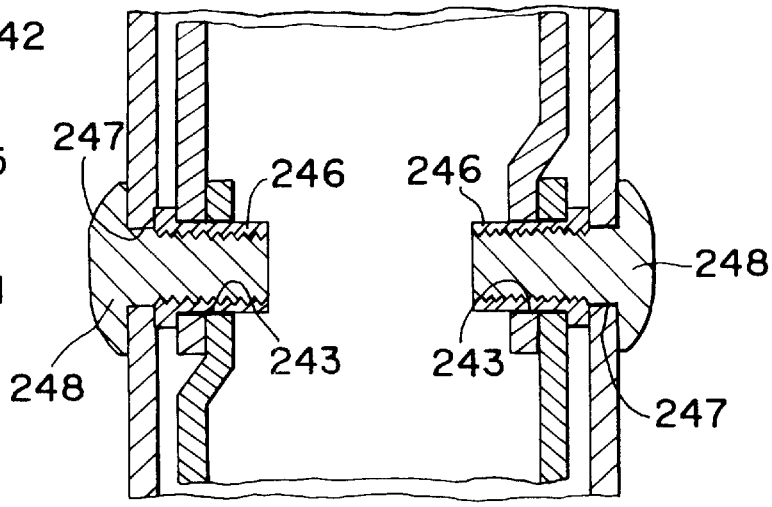
FIG. 25 is a cross-sectional view of the rocker arm and chassis taken along line 25—25 in FIG. 20.

As seen in FIG. 25, the arms 235 are connected to the tracking system using two truncated pivoting axles 246. Referring back to FIG. 20, for each pair of pivoting arms 235, one set of truncated axles 246 is provided so that pivot arms rotate about the same axles. The truncated axles 246 fit through a hole 247 in the tracking system and holes 243 in pivoting arm 235. The truncated axle 246 is generally cylindrical and has a smooth outer surface and can have a threaded inner surface. In a preferred embodiment, the truncated axles 246 are positioned in the holes 243 and 247. A bolt 248 fits through the holes 243 and into the threaded inner surface of the truncated axle 246 to secure the arms 235 and truncated axles 246 to the tracking system. This arrangement allows the smooth outer surface to rotate within the holes 243, 246 so that the arms pivot about the truncated axles 246.

The purpose of the truncated axles 246 is to reduce the space between the wheels. If one solid axle was to extend from one side of the tracking system and pivoting arm to the other side, the space between would have to be greater than the diameter of the axle. The truncated axle 246 permits the wheels to be close enough to one another so that there is enough clearance between the wheels for them to rotate correctly. The use of the truncated axles also allows the wheels to be configured with small clearances between each wheel. By reducing the clearances between the wheels, different size wheels can be used, the size of the suspension mechanism can be reduced, the weight of the skates can be reduced, and the performance of the skate can be improved.

Figure 26:
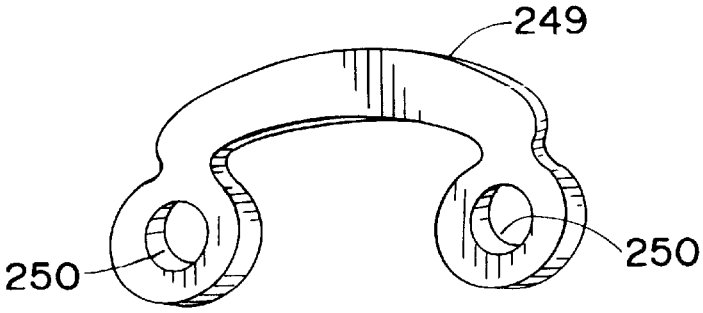
FIG. 26 is a perspective view of a cross-brace used by an alternative embodiment of the present invention.

In an alternative embodiment of the present invention, a cross-brace 249 as shown in FIG. 26 can be added to the suspension mechanism 212. The cross-brace 249 is generally C-shaped and has holes 250 at each end. The holes 250 can be threaded. The truncated axle 246 can be configured with a threaded outer end which can be screwed into the cross-brace holes 250. The cross-brace 249 thereby secures the truncated axle 246 to the arms 235 and the side panels 224, 226. The cross-brace 249 is configured to pass over adjacent wheels 238 so that the arrangement can maintain the small clearances between the wheels that are desired. The cross-brace 249 also provides additional support and rigidity to the truncated axles 246 and the suspension mechanism 212.

The notch 243 and lip 245 are designed to mate with a stop 252 that is connected to the tracking system 218. In the preferred embodiment, the stop 252 is a round protrusion that extends between the two side panels 224, 226 and can be the head cap of a screw. The notch 246 therefore has a general semi-circular shape to mate with the stop 252. The lip 245 can have a rounded surface to mate with the stop 252. As can be appreciated, the notch 253, or lip 245, and stop 252 combination prevent the wheels from pivoting too far around the pivot axle 246 and keep the wheels in the proper position. For the notch 243, the stop 252 is positioned towards the lower end of the side panels 224, 226. For the lip 245, the stop is positioned towards the upper end of the side panels 224, 226. The lip and stop requires less effort to stop the downward motion of the rocker arm 235. In addition, the location of the stop reduces the stress on the stop and the arms. Furthermore, the location at the top of the rocker arm reduces the amount of hardware where the wheels are located thereby ensuring that clearances are kept to a minimum.

Between the arms 235 and above the pivot axles 241, a biasing device, or spring 255, is provided. The spring 255 biases the arms into position after the arms are compressed into the spring. In the preferred embodiment, the spring 255 is made of polyurethane. The suspension system 212 can accommodate springs of various strengths.

Figure 27A:
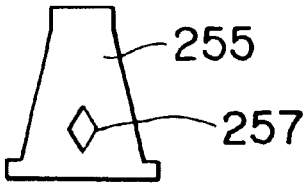
FIG. 27*a* is a side view of one embodiment of a spring used by the present invention.
Figure 27B:
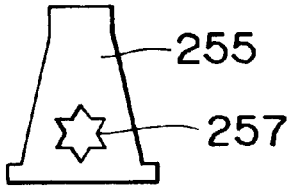
FIG. 27*b* is a side view of another embodiment of a spring used by the present invention.
Figure 27C:
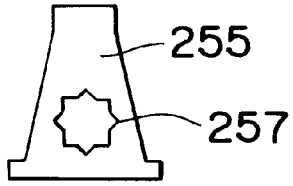
FIG. 27*c* is a side view of yet another embodiment of a spring used by the present invention.

A solid polyurethane spring is generally quite rigid. Springs 255 made in accordance with the principles of the present invention are shown in FIGS. 27–30 and are made to overcome the rigidity found in prior art springs. It has been found that adding a hole 257 through the polyurethane spring 255 provides a more flexible spring. As seen in FIGS. 27*a–c*, the hole 257 can be of any general shape wherein each shape provides for different degrees of variability for the spring, as described below. The hole 257 provides space into which polyurethane material can move in addition to the regular elasticity of the polyurethane. The size and dimension of the hole 257 can effect the rigidity of the spring. As can be appreciated, the larger the surface are of the hole 257 the more variability that is provided by the spring 257.

Figure 28:
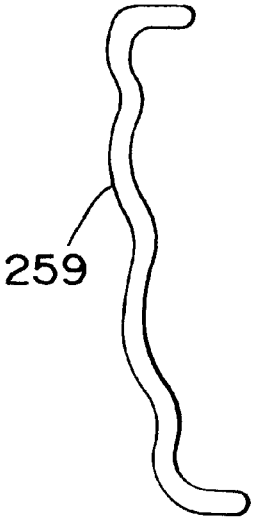
FIG. 28 is a drawing of the spring adjustment mechanism.

Furthermore, the springs 255 can be adjustable so that a skater can vary the tension or resistance of the spring for different skating surfaces. In order to provide for different adjustments, the hole 257 can be a variety of shapes, some of which are shown in FIGS. 78*a–c*, such as a star or diamond (not shown). In order to adjust the strength of the spring 255, an adjustment post 259 is placed into the hole. As seen in FIG. 28, the adjustment post 259 has a variable wave-like shape. The size of the adjustment post 259 from the furthest edges formed by the wave-like shape is proximate the size of the hole 257 so that the post 259 fits easily into the hole while engaging the spring 257 at the sides of the hole 257. The adjustment rod 259 is made of a suitably rigid material so that it can contribute to the variability of the spring. The adjustment rod 259 must also be flexible so that when the spring 255 flexes within the confines of the hole 257 the integrity of the rod is maintained and that it will return to its original shape when the force is removed from the spring.

Figure 29:
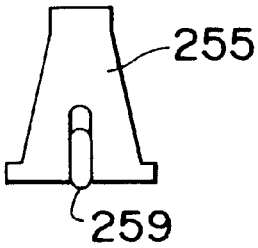
FIG. 29 is a side view of the spring with the spring adjustment mechanism in one position.
Figure 30:
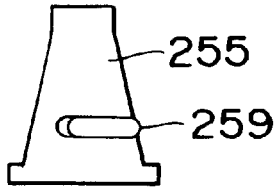
FIG. 30 is a side view of the spring with the spring in a second adjusted position.

FIGS. 29 and 30 illustrate the spring 255 with the adjustment post 259 in two different positions thereby changing the rigidity of the spring. In FIG. 29, the post 259 is in the vertical position whereby the spring material is given the greatest area to flex within the hole 257. In FIG. 30, the post 259 is in the horizontal position. In that position, the spring material does not have the same ability to deform, or flex within the hole and provides a more rigid spring than that compared to FIG. 29. In addition, the adjustment rod contributes to the rigidity of the spring 255. The adjustment post 259 can be rotated between the vertexes of the hole to vary the strength of the spring. As the post 259 rotates from a vertical orientation to a horizontal orientation the strength of the spring is increased. As the post is moved to the horizontal, the resistance within the space is increased thereby making a more rigid spring.

Figure 31:
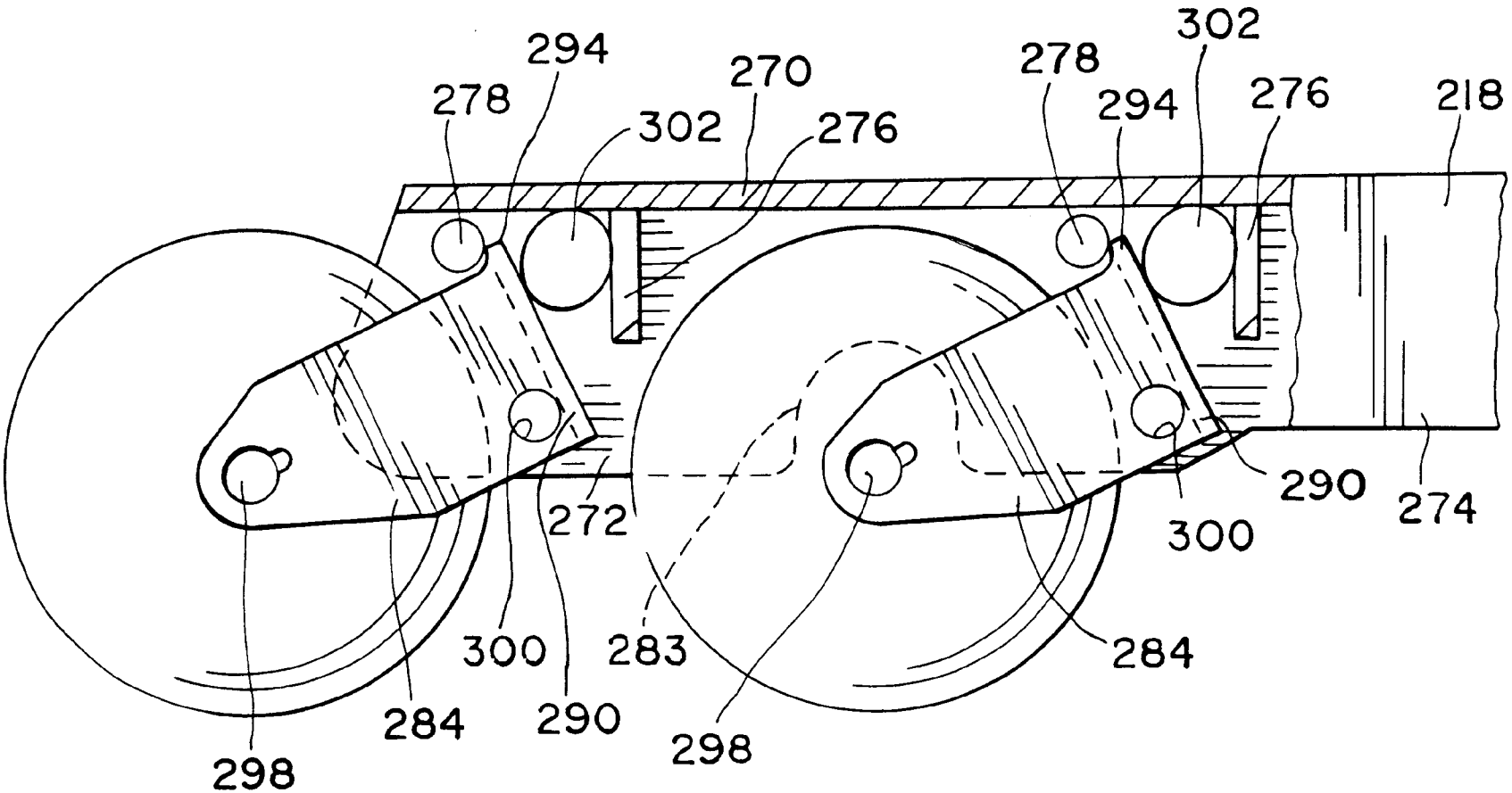
FIG. 31 is a drawing of another embodiment of the present invention.

The adjustable spring 255 can also be used for suspension mechanism where the rocker arms 235 are individually connected to the tracking system 218 as seen in FIG. 31. The tracking system 218 includes an upper surface 270, which connects the suspension mechanism to the boot, and opposing sides 272, 274 extending perpendicular from the longitudinal edges of the upper surface. In this embodiment the tracking system 218 includes baffles 276 extending down from an upper surface 270. Proximate the upper surface 272, the tracking system is configured with stops 278. The distal edge of the sides 272, 274 can have a series of arches 283.

The suspension system includes a rocker arm 284 which has a C-shaped cross section having sides connected by a yoke 290. Each side has a somewhat triangular shape at one vertex of the rocker arm 284. A lip 294 extending between the sides along the yoke 290.

To form the suspension mechanism, the wheels are attached to the rocker arms by an axle 298. Each rocker arm is connected to the tracking system by a pivot axle 300. The wheel axle 298 is aligned with the arches 283. The rocker arm 235 is arranged in the tracking system so that the lip 294 is proximate the upper surface 270 and between stop 280 and baffle 276. A spring as described above is biased between the yoke 290 and the baffle 276 so that the lip is biased against the stop 278.

In operation, the wheel moves in an arcuate path around the pivot axle when it encounters an uneven surface. The yoke 290 is pushed against the spring 302, and the spring is displaced into empty regions between the spring, the baffle and the yoke. The spring will then bias the rocker arm back towards the stop and the lip will restrict the path of the arm.

Figure 32:
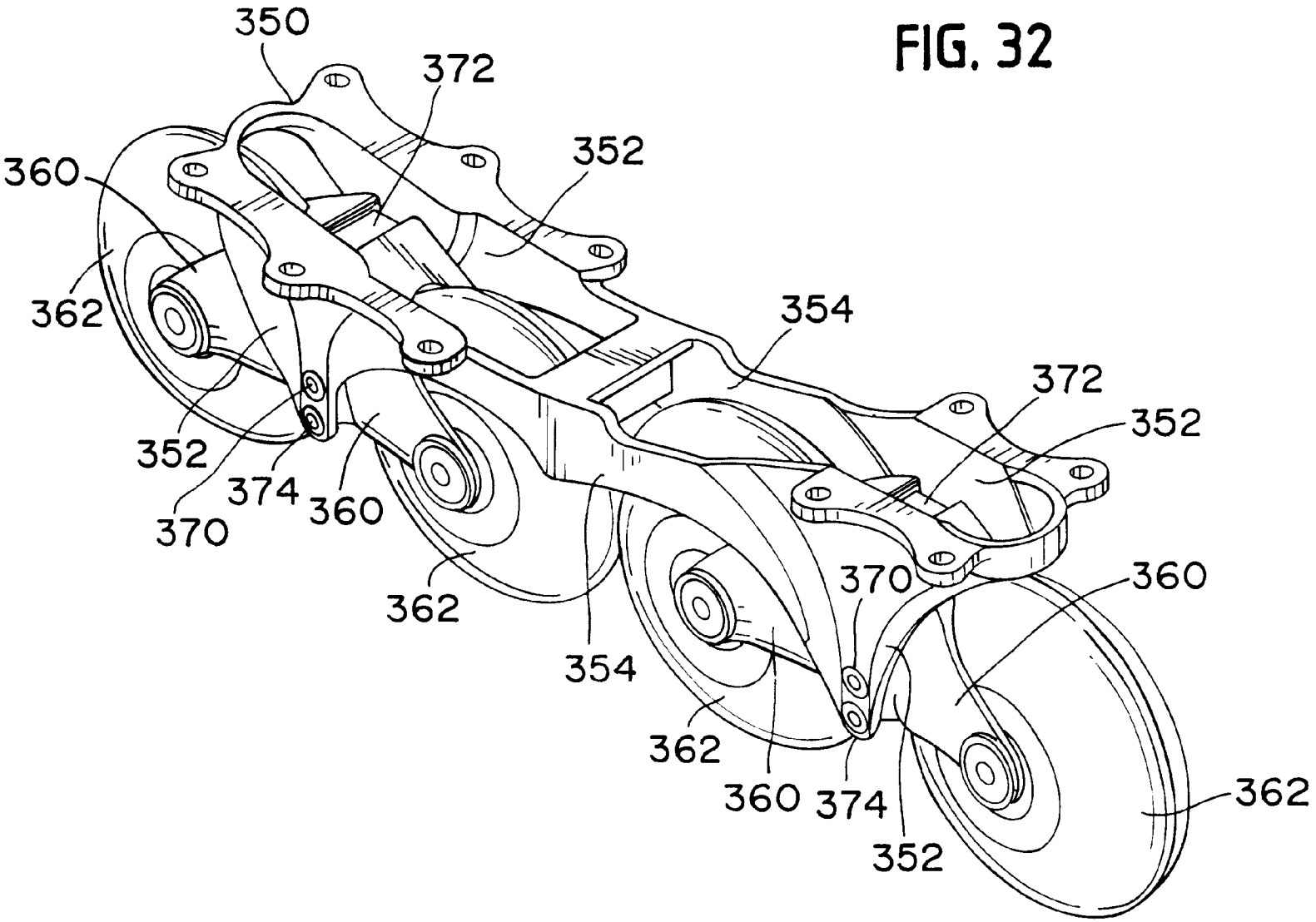
FIG. 32 is a perspective drawing of yet another embodiment of the present embodiment.
Figure 33:
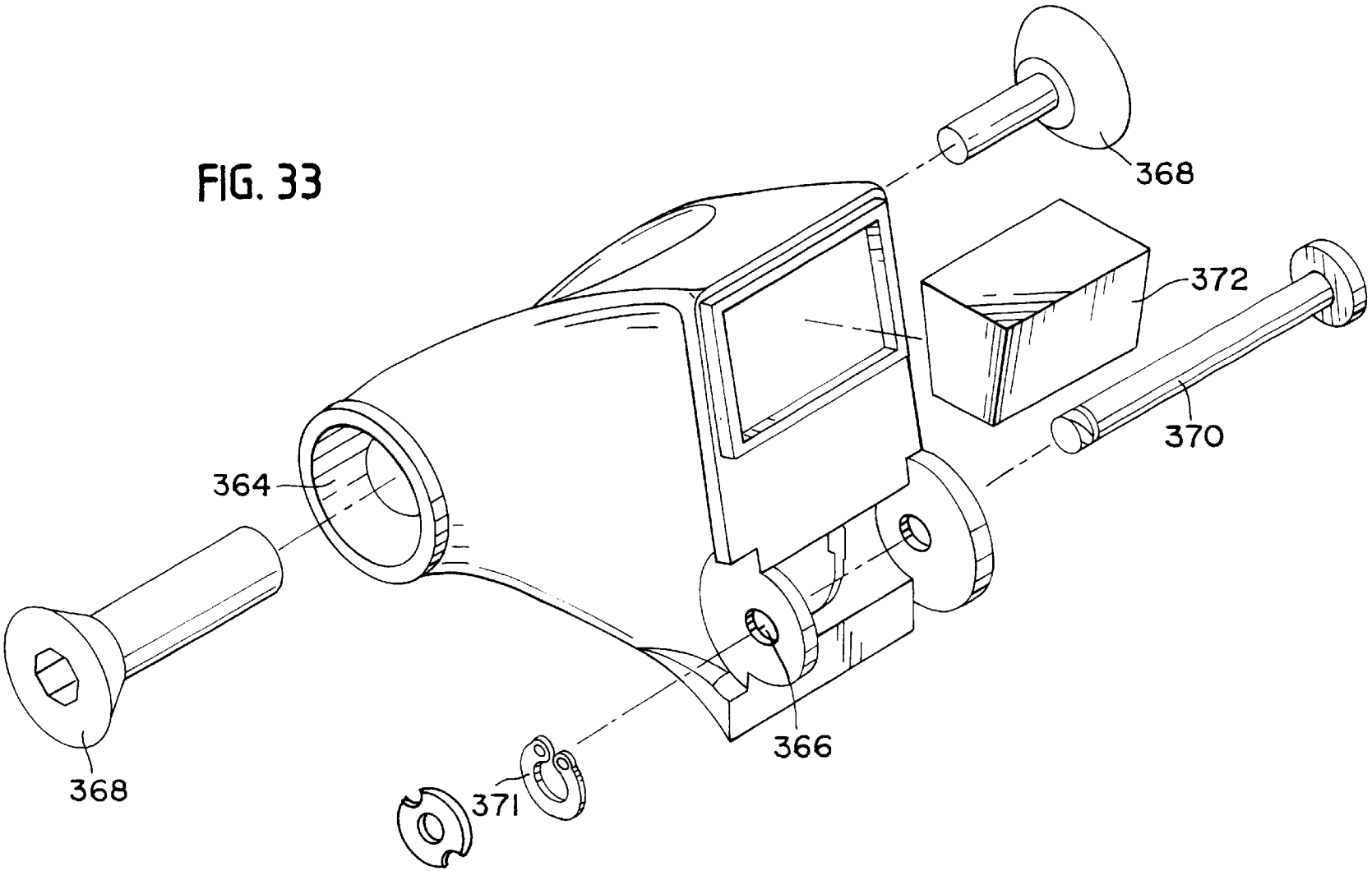
FIG. 33 is a drawing of the rocker arm of the embodiment shown in FIG. 34.
Figure 34:
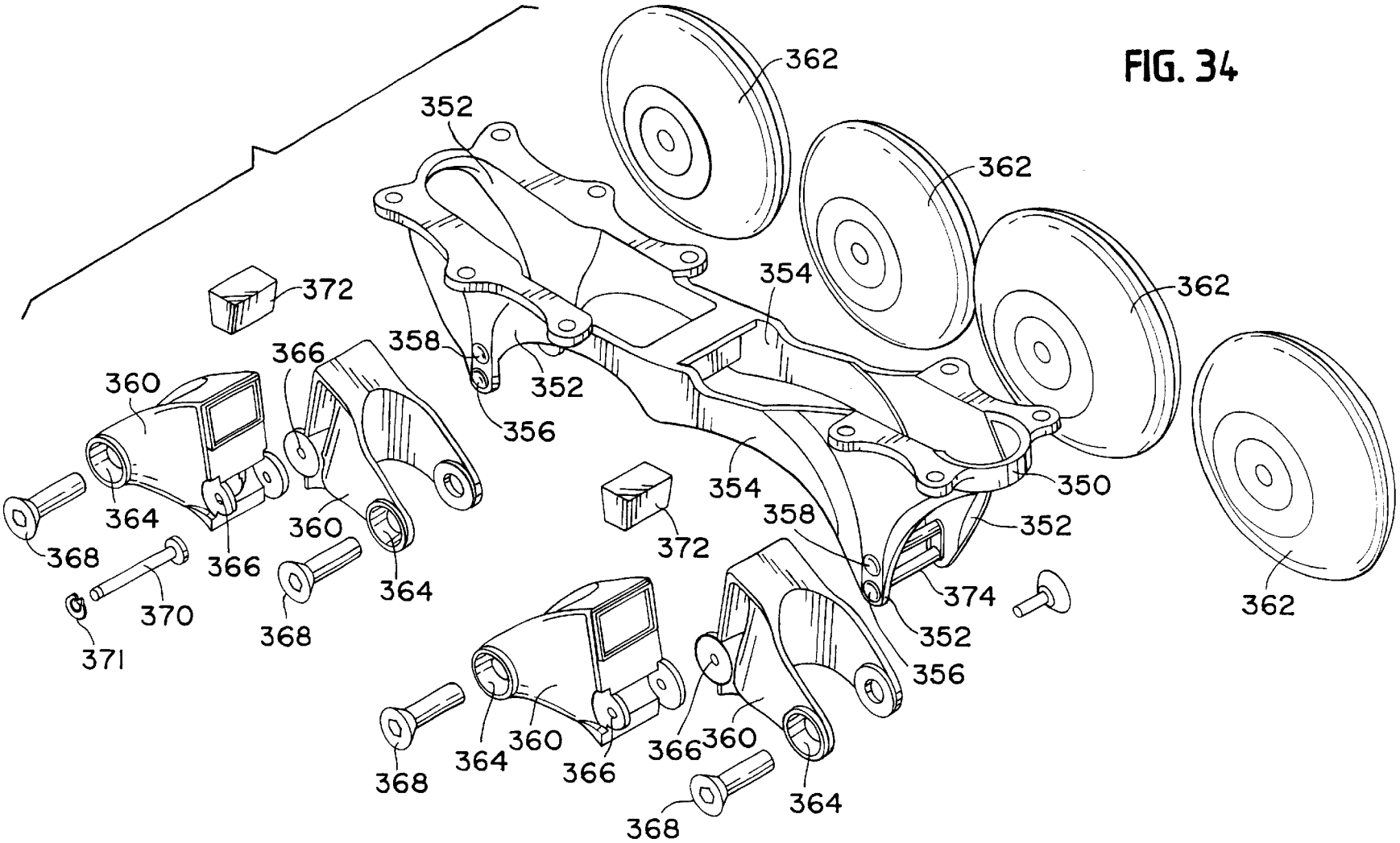
FIG. 34 is a drawing of the parts of the embodiment shown in FIG. 34.

FIGS. 32–34 show yet another embodiment of the present invention. In this embodiment the tracking system 350 connects to the underside of the boot's sole in a described manner. The tracking system includes two generally V-shaped portions 352 on each side panel 354. Proximate its vertex, each V-shaped portion has two vertically aligned holes 356 and 358.

Rocker arms 360 having a generally triangular side and a c-shaped cross section are provided to connect the wheels 362 to the tracking system. The rocker arms 360 are designed and connected to the tracking system so that the wheels can move in an arcuate path relative the boot when they encounter an uneven surface. As seen in FIG. 32, the open end of the rocker arms is wider than the closed end so that the rocker arms closely surround the wheels 362. This shape of the rocker arms 360 reduces the clearance space of the skate and provides for a greater range of motion for the skater as the skate moves from side to side. Near the lower edge of the rocker arms 360, holes 364 and 366 are provided on opposing edges.

Wheels 362 are connected by an axle 368 to each rocker arm 360 through hole 364. In this embodiment, holes 364 can be recessed so that the axle 368 can fit within the space of the rocker arm 360 thereby keeping the width of the rocker arm and the system as small as possible. This provides greater mobility for the skater and a wider range of motion as the skate is moved from side to side. In the preferred embodiment, axle 368 is composed of two parts having conical ends where the conical ends fit into the recessed holes.

The rocker arms 360 are connected to the tracking system by a pivot axle 370 that fits in upper hole 366. A snap ring 371 can be used to secure the axle. As seen in the figures, the pivot axle 370 connects to opposing rocker arms to one V-shaped portion through hole 358. A spring 372 of the type described above fits between the upper ends of the opposing rocker arms. Spring 372 preferably has a trapezoidal shape and can be adjustable as described above. A stop rod 374 is provided between the rocker arms and is positioned in lower hole 358 thereby opposing the spring 372. In a resting position, spring 372 biases opposing rocker arms 360 against stop rod 374. When a wheel encounters an uneven surface, the wheel move in arcuate path about the pivot axle and against the spring. The spring biases the wheel back against the stop.

The configuration of the rocker arms, pivot points, springs and stops in the above embodiments of the present invention provide a smoother and less stressful ride for skaters. The arcuate path of the rocker arms about the pivot axle is balanced by the arrangement of the spring and stop. The vertical motion of the wheels is therefore transferred into horizontal motion that is counterbalanced by the spring. The spring, or other biasing means such as the material of the rocker arm, limits the path of the rocker arm and biases the rocker arm against the spring. The biased movement of the rocker arm is limited by the stop. As described, the rocker arms can be arranged to be opposing whereby a and a stop is positioned between the opposing rocker arms.

I claim:

1. A suspension system for an inline skate comprising:

a tracking system connected to a skate boot wherein the tracking system has two sides extending from an upper surface;

opposing rocker arms disposed within the sides of the tracking system wherein a wheel is rotatably connected to each rocker arm for limited rotation;

an axle pivotally connecting each rocker arm to the tracking system; and a spring interposed within the tracking system between each opposing rocker arm below the upper surface and above the axle, to bias the rocker arms away from one another and to limit the upward rotation of the rocker arms wherein a stop engages each rocker arm to limit the downward motion of each rocker arm.

2. The system of claim 1 wherein a pair of opposing rocker arms are pivotally connected to the tracking system by a single axle.

* * * * *